US008550558B2

(12) United States Patent
Fu

(10) Patent No.: US 8,550,558 B2
(45) Date of Patent: Oct. 8, 2013

(54) CHAIR WITH TILTING BACKREST

(76) Inventor: Jianhua Fu, Zhejiang (CN)

( * ) Notice: Subject to any disclaimer, the term of this patent is extended or adjusted under 35 U.S.C. 154(b) by 210 days.

(21) Appl. No.: 13/113,086

(22) Filed: May 23, 2011

(65) Prior Publication Data

US 2012/0193961 A1 Aug. 2, 2012

(30) Foreign Application Priority Data

Jan. 30, 2011 (CN) ..... 2011 1 0033706

(51) Int. Cl.
*A47C 1/032* (2006.01)

(52) U.S. Cl.
USPC ..... 297/342; 297/340; 297/341; 297/343

(58) Field of Classification Search
USPC ..... 297/340, 341, 342, 343
See application file for complete search history.

(56) References Cited

U.S. PATENT DOCUMENTS

| | | | | |
|---|---|---|---|---|
| 7,014,263 | B2 * | 3/2006 | Mukoujima et al. | 297/341 X |
| 7,794,017 | B2 * | 9/2010 | Kan et al. | 297/340 |
| 8,038,217 | B2 * | 10/2011 | Yamagishi et al. | 297/341 |
| 2011/0074197 | A1 * | 3/2011 | Okamoto | 297/340 X |
| 2011/0291452 | A1 * | 12/2011 | Ko | 297/340 |
| 2011/0291453 | A1 * | 12/2011 | Schmitz et al. | 297/340 |

* cited by examiner

*Primary Examiner* — Rodney B White
(74) *Attorney, Agent, or Firm* — Global IP Services; Tianhua Gu

(57) ABSTRACT

A chair comprises a seat, a backrest and a chair base, wherein the backrest and the chair base are connected through a first connector, that comprises a base holder rigidly connected to the chair base, a back holder secured to the backrest, a rotation holder, a first linkage bar, a second linkage bar and a third linkage bar. The chair solves the problem that a user's clothes is pulled up when the backrest of the chair is turned backward in the traditional chair.

10 Claims, 7 Drawing Sheets

CHAIR WITH TILTING BACKREST

CROSS REFERENCE TO RELATED PATENT APPLICATION

The present application claims the priority of Chinese patent application No. 201110033706.4 filed on Jan. 30, 2011, which application is incorporated herein by reference.

FIELD OF THE INVENTION

The present invention relates to furniture, particularly to a chair.

BACKGROUND OF THE INVENTION

As people's living standards improve, their demands for high quality life is increased more and more. The traditional wooden or bamboo chairs are gradually replaced by those with elegant style and multifunctionality. Modern chairs are designed more and more user-friendly chairs, which meet consumers' needs for comfort and convenience. One of the modern chairs has a backrest tilt angle which is adjustable to allow people to sit more comfortably by changing the angle between the seat and the backrest. However, during a backrest turning backward, the turning center and turning radius of the backrest are different from those of the user's body, therefore the user's clothes is pulled up by the friction between the backrest and the user, which results in unpretty wrinkles or even damages of the clothes, or results in exposures of the user's waist which causes embarrassment on some occasions. Thus, the purpose of the present invention is to provide a rotary chair which can avoid the pulling up of a user's clothes when the backrest is turned backward.

SUMMARY OF THE INVENTION

The purpose of the present invention is to provide a chair, which solves the technical problem mentioned above through a linkage movement of the seat and the backrest.

To achieve this objective, the present invention applies the following technical solution:

A chair, comprises a seat, a backrest and a chair base, wherein the backrest and the chair base are connected through a first connector, that comprises a base holder rigidly connected to the chair base, a back holder secured to the backrest, a rotation holder, a first linkage bar, a second linkage bar and a third linkage bar. The rotation holder is pivotally connected to the base holder; the back holder is non-rigidly connected to the rotation holder through a linear sliding connection; one end of the first linkage bar is pivotally connected to the back holder, a second end of the first linkage bar is pivotally connected to the third linkage bar; one end of the second linkage bar is pivotally connected to the rotation holder, a second end of the second linkage bar is pivotally connected to the third linkage bar; an end of the third linkage bar is pivotally connected to the base holder. As a result, when the end herein is considered a near end, the pivot point of the first linkage bar and the third linkage bar is located at a far end of the third linkage bar and the pivot point of the second linkage bar and the third linkage bar is located in the middle of the third linkage bar. A reposition mechanism utilized to move the backrest forward to return to its original position during the backrest turning backward and a position mechanism utilized to position the backrest at a tilt angle are installed on the chair base.

In a preferred embodiment of the present invention, a guide rail is provided on the rotation holder, a sliding block is provided on the guide rail, and the sliding block is rigidly connected to the back holder.

The seat is mounted on the chair base. But in a preferred embodiment of the present invention, the seat and the chair base are connected through a second connector that comprises a base support fixed to the chair base, a back support fixed to the backrest and a seat support secured to the seat, wherein the lower end of the back support is pivotally connected to the back end of the base support; the higher end of the back support is pivotally connected to the back end of the seat support; the front end of the seat support is pivotally connected to the higher end of the connecting plate; and the lower end of the connecting plate is pivotally connected to the front end of the base support. Thus the base support, the back support, the seat support and the connecting plate comprise a four-bar linkage.

In a preferred embodiment of the present invention, the reposition mechanism includes a extension spring; one end of the extension spring is connected to the base support; a fixed lever is provided between the pivot point of the back support and the seat support and the pivot point of the back support and the base support; the other end of the extension spring is connected to the fixed lever; and the fixed lever penetrates the base support through a guide hole or a guide slot inside which the fixed lever is movable. Further, in the preferred embodiment, a rotatable tensioning bolt is provided inside the base support; the tensioning bolt is screwed into the screw at an end of the extension spring; a rotatable adjusting lever is provided on the base support; and the adjusting lever is coupled to the cross shaft of the tensioning bolt.

In a preferred embodiment of the present invention, the position mechanism comprises a finger clamp on a fixed lever, a clamp tooth provided at the front end of the finger clamp, and a plurality of clamp slots fitting to the clamp tooth respectively are provided on the base support. Further in the preferred embodiment, a finger clamp control mechanism utilized to restrict the rotation of the finger clamp is provided on the base support or the back support.

The back support of the second connector is pivotally connected to the rotation holder of the first connector. Otherwise, the back support of the second connector is non-rigidly connected to the backrest through a guide sliding slot and a sliding wheel.

The above technical solution of the present invention solves the problem caused in using a traditional chair, the problem is pulling up of a user's clothes when the backrest of the chair is turned backward. The present structure of the linkage movement not only makes a user feel more comfortable, but also is more user-friendly, thereby avoiding the damage of the user's clothes.

DETAILED DESCRIPTION OF THE INVENTION

Detailed Illustrations of preferred embodiments of the present invention are provided in the following.

Embodiment 1

Figure 1:
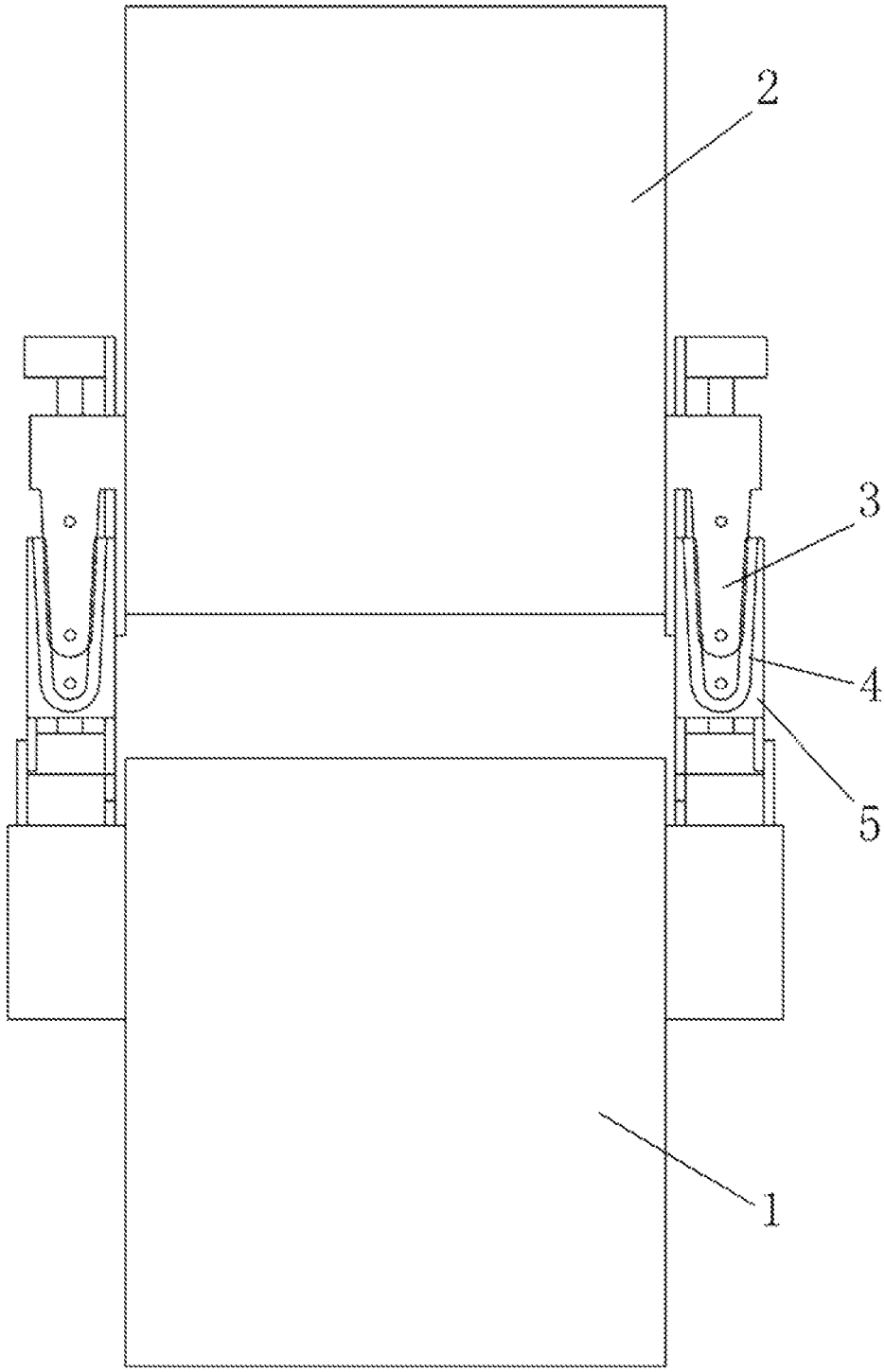
FIG. 1 is a structure diagram of a chair in accordance with the present invention.
Figure 2:
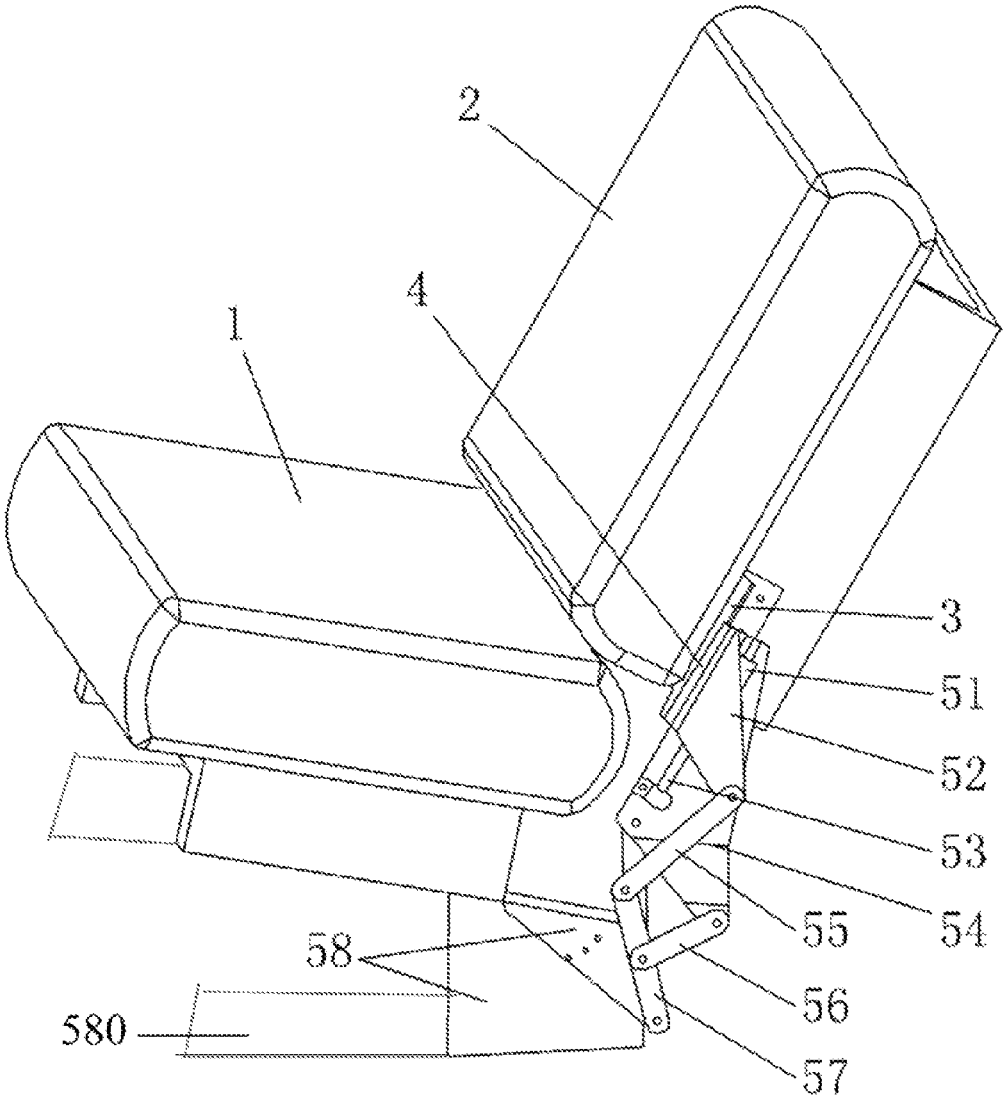
FIG. 2 is a structure diagram of a chair in accordance with embodiment 1 of the present invention.

A chair as shown in FIGS. 1 and 2, comprising a seat 1, a backrest 2 and a chair base 580, wherein the seat 1 and the backrest 2 are connected through a first connector 5; a wedge-shaped insert member 3 is provided on the backrest 2; a wedge-shaped case member 4 fitted to the insert member 3 is provided on the first connector 5; and the wedge-shaped insert member 3 is inserted into the wedge-shaped case member 4. In this embodiment, one wedge-shaped insert member 3 is provided on each side of the backrest 2, and each wedge-shaped insert member 3 is inserted into a case member 4 of the first connector 5 on each side of the seat 1 respectively. The connection of the backrest and the connector through a wedge-shaped insert and case members offers advantages such as accurate positioning, secure fitting, easy assembly or disassembly, easy adjustment, etc.

Figure 3:
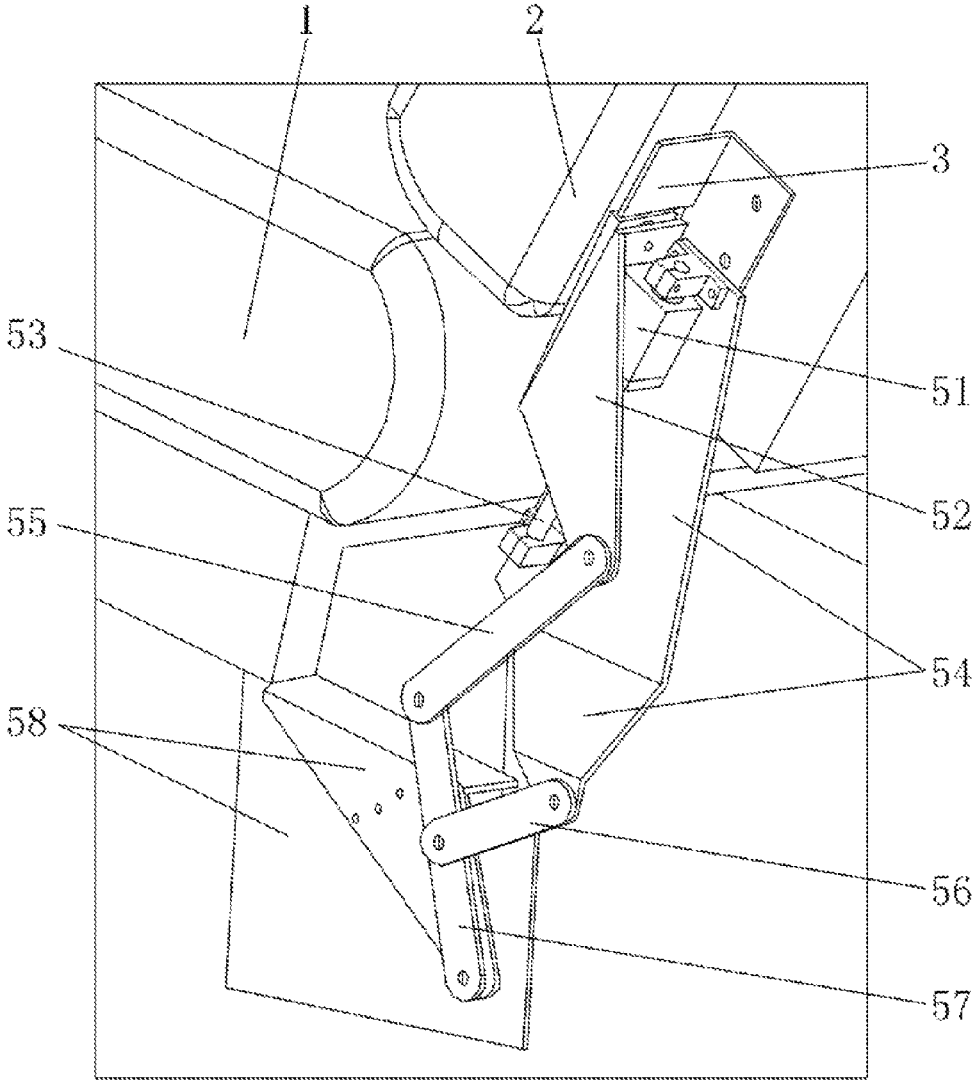
FIG. 3 is a structure diagram of a first connector in accordance with embodiment 1 of the present invention.

As shown in FIGS. 2 and 3, the first connector 5 comprises a base holder 58, a back holder 52, a rotation holder 54, a first linkage bar 55, a second linkage bar 56 and a third linkage bar 57. In this embodiment, the base holder 58 is a part of the chair base 580 and they are rigidly connected to the seat 1; the wedge-shaped case member 4 is provided on the back holder 52; the wedge-shaped insert members 3 on both sides of the backrest 2 are inserted into the case members 4, thereby fixing the backrest 2 to the back holder 52; the rotation holder 54 is pivotally connected to the base holder 58; a guide rail 53 is provided on the rotation holder 54; a sliding block 51 is provided on the guide rail 53; the sliding block 51 is rigidly connected to the back holder 52, thereby allowing the back holder 52 sliding linearly relative to the rotation holder 54 (Herein, a plurality of specific structures of the sliding connector are available, such as a structure with the guide rail and the sliding block being set up reverse order, a structure employing a sliding slot and a sliding block, or even a structure employing a linear bearing or a linear shaft, whereof the sliding direction is parallel to radial direction of the rotation axis of the rotation holder). One end of the first linkage bar 55 is pivotally connected to the back holder 52, and the second end of the first linkage bar 55 is pivotally connected to the third linkage bar 57; one end of the second linkage bar 56 is pivotally connected to the rotation holder 54, and the second end of the second linkage bar 56 is pivotally connected to the third linkage bar 57; an end of the third linkage bar 57 is pivotally connected to the base holder 58, as a result, when the end herein is considered a near end, the pivot point of the first linkage bar 55 and the third linkage bar 57 is located at a far end of the third linkage bar 57 and the pivot point of the second linkage bar 56 and the third linkage bar 57 is located in the middle of the third linkage bar 57. Three linkage bars provided between the base holder 58, the back holder 52 and the rotation holder 54 to consist of a linkage structure, wherein the base holder 58 is served as a reference for the rotation of the backrest, and the rotation holder 54 is utilized to achieve the rotation of the backrest. In the rotation process of the rotation holder 54, the second linkage bar 56 actuates the third linkage bar 57 to rotate around the pivot point of the base holder 58 and the third linkage bar 57, subsequently the rotation of the third linkage bar 57 actuates the movement of the first linkage bar 55, and the displacement of the first linkage bar 55 actuates the slide of the pivotally connected back holder 52, thereby achieving a linkage movement of the back holder 52 and the rotation holder 54. The purpose of employing the linkage mechanism is to eliminate or reduce as much as possible the distance change between the seat's inside edge (facing the caudal vertebrae of the body) and the backrest's bottom edge (facing the lumbar vertebrae of the body) while the backrest is turned backward, and therefore avoids a user's discomfort. The specific size of each part included in the above linkage structure can be obtained through limited tests according to the actual needs by the technical stuff from the related field, and creative work is not necessary.

The above structure achieves a linkage between the rotation and the slide of the backrest, but as a chair whose backrest can be turned backward, a reposition mechanism is also required to provide a force to always pull the backrest back to its original position when it is inclined backward. It may be a mechanism comprising an air spring (or an extension spring). One end of the air spring is non-rigidly connected to the seat (or the chair base), and the second end of the air spring is non-rigidly connected to the backrest (or the back holder 54).

As a preferred embodiment of the present invention, a position mechanism is also required to position the backrest at a tilt angle when it is turned backward. A position mechanism may comprise a rotary table with multiple positioning holes and a positioning spring pin. The rotary table is fixed on the pivot axis of the base holder 58 and the rotation holder 54 of the first connector 5 and provided to rotate synchronically with the rotation holder 54, and the spring pin is provided on the seat or the base holder 58. A gear positioning mechanism can be achieved by inserting the spring pin into one of the positioning holes. Similarly, the rotary table may be integrated to the rotation holder 54. Furthermore, the pin-hole mechanism may be replaced by a ratchet pawl mechanism.

Embodiment 2

Figure 4:
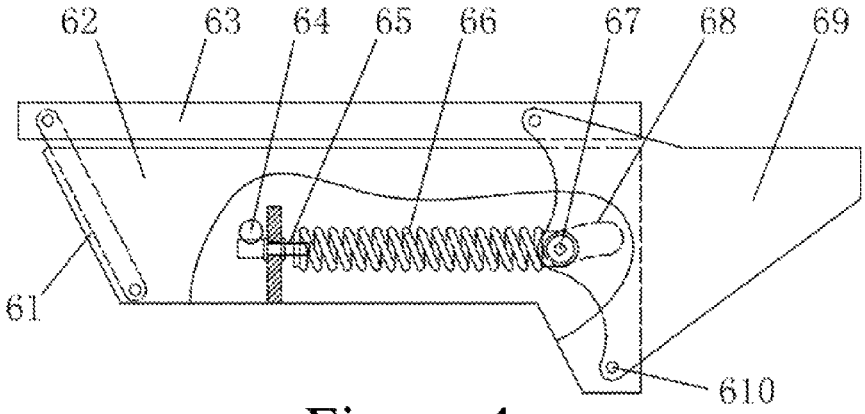
FIG. 4 is a structure diagram of a second connector in accordance with embodiment 2 of the present invention
Figure 5:
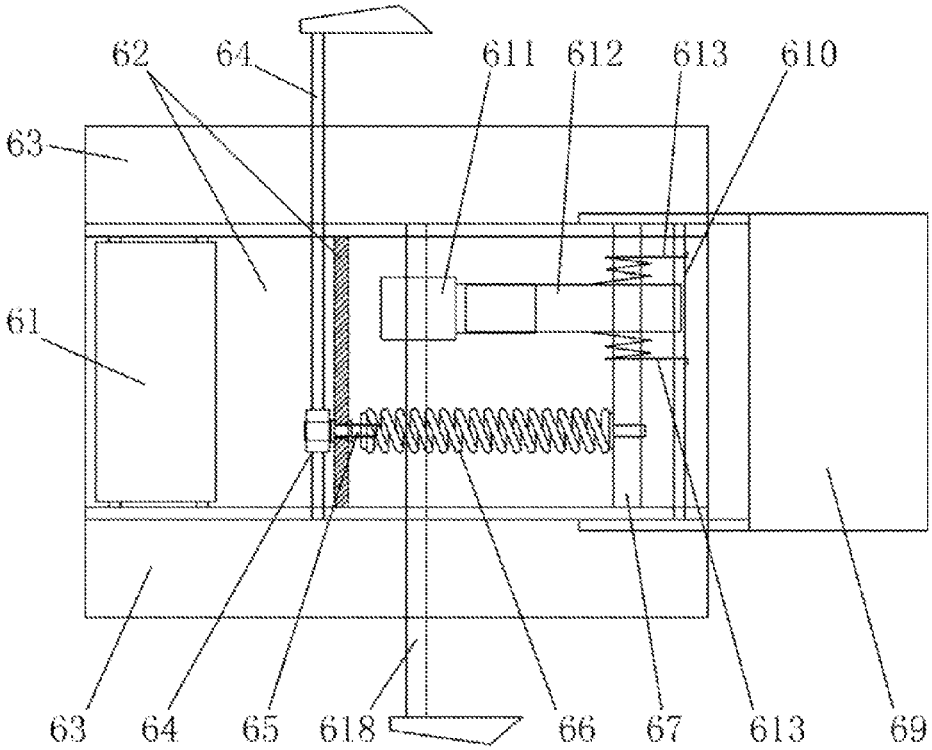
FIG. 5 is a top view of the second connector shown on the FIG. 4.

A chair, comprising a seat, a backrest and a chair base, wherein the seat and the backrest are connected through a second connector as shown in FIGS. 4 and 5, which comprises a base support 62 fixed to the chair base, a back support 69 fixed to the backrest and a seat support 63 secured to the seat, wherein the lower end of the back support 69 is pivotally connected to the back end of the base support 62, the higher end of the back support 69 is pivotally connected to the back end of the seat support 63, the front end of the seat support 63 is pivotally connected to the higher end of a connecting plate 61, and the lower end of the connecting plate 61 is pivotally connected to the front end of the base support 62, therefore the base support 62, the back support 69, the seat support 63 and the connecting plate 61 consist of a four-bar linkage. When the backrest is turned backward, the backrest actuates the back support 69 to rotate clockwise, subsequently the back support 69 actuates the seat support 63 along with the seat to move backward, thereby achieving a linkage movement of the backrest and the seat. As described in embodiment 1, the purpose of employing a linkage mechanism is to eliminate or reduce as much as possible the distance change between the seat's inside edge (facing the caudal vertebrae of the body) and the backrest's bottom edge (facing the lumbar vertebrae of the body) while the backrest is turned backward, and therefore avoids a user's discomfort. The specific size of each part included in the above linkage structure can be obtained through limited tests according to the actual needs by the technical stuff from the related field, and creative work is not necessary.

The above structure achieves a linkage movement that the backrest's rotation actuates the seat's slide, but as a chair whose backrest can be turned backward, a reposition mechanism is also required to provide a force to always pull the backrest back to its original position when it is turning backward. In this embodiment, an extension spring 66 (may be an air spring or one or more parts that provides elasticity) is adopted to provide the reset force. One end of the extension spring 66 is connected to base support 62, and the second end of the extension spring 66 is connected to the back support 69. To ensure that the extension spring works effectively, preferably the connection point of the extension spring 66 and the back support 69 is placed between the two pivot points through which the back support 69 is connected to the seat support 63 and the base support 62 respectively. To limit the movement range of the four-bar linkage, a fixed lever 67 is provided inside the back support 69. The fixed lever 67 penetrates the base support 62 through a guide hole (or a guide slot) 68 inside which the fixed lever 67 is movable, thus during the movement of the four-bar linkage, the guide hole (or the guide slot) 68 can limit the movement range of the back support 69 by limiting the movement range of the fixed lever 67. To eliminate or decrease the collision probability and friction between the fixed lever 67 and the guide hole (or the guide slot) 68, preferably a wear resistance sleeve or a rubber sleeve is provided inside the guide hole (or the guide slot) 68, furthermore preferably shafts are provided at both ends of the fixed lever 67 to aid moving smoothly. To ease assembly and adjustment, the fixed lever 67 inside the back support 69 is connected to one end of the extension spring 66; a panel is provided inside the base support 62; a rotatable tensioning bolt 65 is provided on the panel; the tensioning bolt 65 is screwed into the other end of the extension spring 66; a rotatable adjusting lever 64 is provided on the base support 62; and the adjusting lever 64 is coupled to the cross shaft of the tensioning bolt 65. Thus the rotation of the adjusting lever 64 will actuate the rotation of the tensioning bolt 65, and further actuate the extension spring 66 connected to the tensioning bolt 65 to stretch or compress, thereby achieving the purpose of adjusting the force to reset the backrest.

Figure 6:
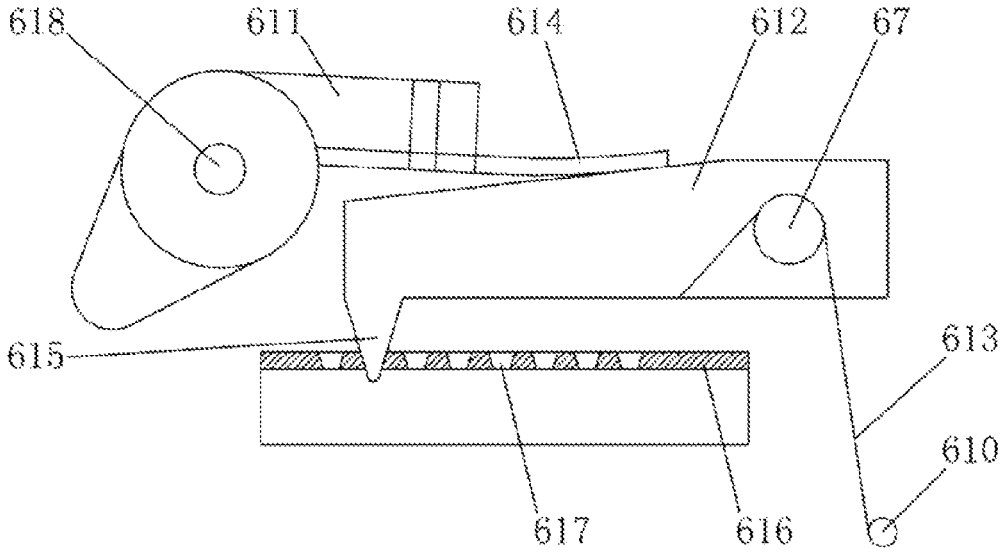
FIG. 6 is a structure diagram of a finger clamp inside the second connector.

As a preferred embodiment of the present invention, a position mechanism is also required to position the backrest at a tilt angle when it is inclined backward. As shown in FIG. 6, such a position mechanism comprises a finger clamp 612 on the fixed lever 67, a clamp tooth 615 provided at the front end of the finger clamp 612, and a clamp slot base 616 provided on the base support 62, wherein a plurality of clamp slots 617 fit to the clamp tooth 615 respectively are provided on the clamp slot base 616. When the clamp tooth 615 on the finger clamp 612 fits into the clamp slot 617, the movement of the fixed lever 67 is restricted and then the rotation of the back support 69 as well as the backrest is restricted, thereby achieving the purpose of positioning. The fixed lever 67 may float through the finger clamp 612 and preferably shafts are provided between the two. In this case, the fixed lever is static when the finger clamp rotates. In another case, the finger clamp 612 is tightened onto the fixed lever 67 and preferably shafts are provided between the fixed lever and the extension spring as well as the guide hole on the base support. Thus the fixed lever will rotate synchronically with the finger clamp. To ensure that the clamp tooth 615 fits into the clamp slot 617 firmly, preferably a finger clamp control mechanism utilized to restrict the rotation of the finger clamp 612 is provided on the base support 62 or (and) the back support 69. Such a control mechanism may have different structures. In one case, a finger press member 611 utilized to restrict the rotation of the finger clamp 612 is placed above the finger clamp, and the finger press member 611 contacts the finger clamp 612 through a flat spring 614; a rotatable adjusting lever 618 is provided on the base support 62; and the finger press member 611 is fixed on the adjusting lever 618. Thus with the aid of a position pin or a positioning stud a gear change mechanism is achieved by rotating the fixed lever 618 to press or release the finger clamp 612. Correspondingly, an elastic reposition mechanism utilized to rotate the finger clamp 612 upward back to its original position is required to be provided on the finger clamp 612. Such an elastic reposition mechanism may also have different structures. Preferably a torsion spring 613 is provided on the fixed lever 67. One end of the torsion spring 613 is connected to the bottom of the finger clamp 612, and the other end of the torsion spring 613 is connected to a pivot shaft 610 of the back support 69 and the base support 62. In another case of the finger clamp control mechanism, an elastic mechanism is employed to always force the finger clamp 612 to rotate downward, thereby ensuring the clamp tooth 615 and the clamp slot 617 remain in fit position. Such an elastic mechanism may be achieved by reversing the above torsion spring. Thus one end of the torsion spring is connected to the top of the finger clamp 612, and the other end of the torsion spring is connected to the pivot shaft 610. Correspondingly, a rotatable control lever is provided on the base support 62 located in front of the finger clamp's 612 clamp tooth, and a toggle is fixed on the control lever, thereby allowing the back support 69 to rotate by rotating the control lever which pushes up the finger clamp 612 to separate the clamp tooth and the clamp slot.

In both above embodiments, the movement range of the seat or the backrest is limited by their mechanisms, thus the range of the tilt angle is limited too. In the following two embodiments, a first connector and a second connector are used together, thus the range of the tilt angle is extended while the movement range of the seat or the backrest is maintained. To eliminate or reduce as much as possible the distance between the seat's inside edge (facing the caudal vertebrae of the body) and the backrest's bottom edge (facing the lumbar vertebrae of the body) during the backrest inclined backward, let the backrest and the seat move at the same time. Thus the movement range of the backrest or the seat is about half of that of the backrest or the seat moving individually while the range of the tilt angle is maintained. Of cause, the specific size of each part included in the linkage structures of the first and second connectors need adjusting to meet the actual requirements, which can be achieved by the technical stuff from the related field through limited tests according to the actual needs without creative work.

Embodiment 3

Figure 7:
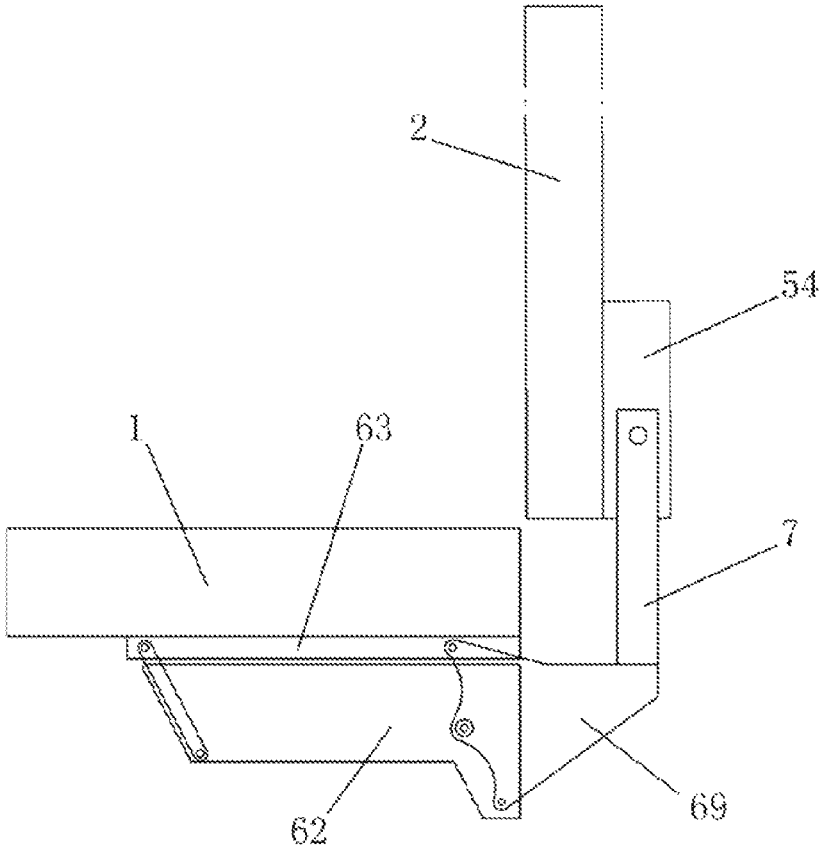
FIG. 7 is a structure diagram of a chair in accordance with embodiment 3 of the present invention (backrest is in original position).
Figure 8:
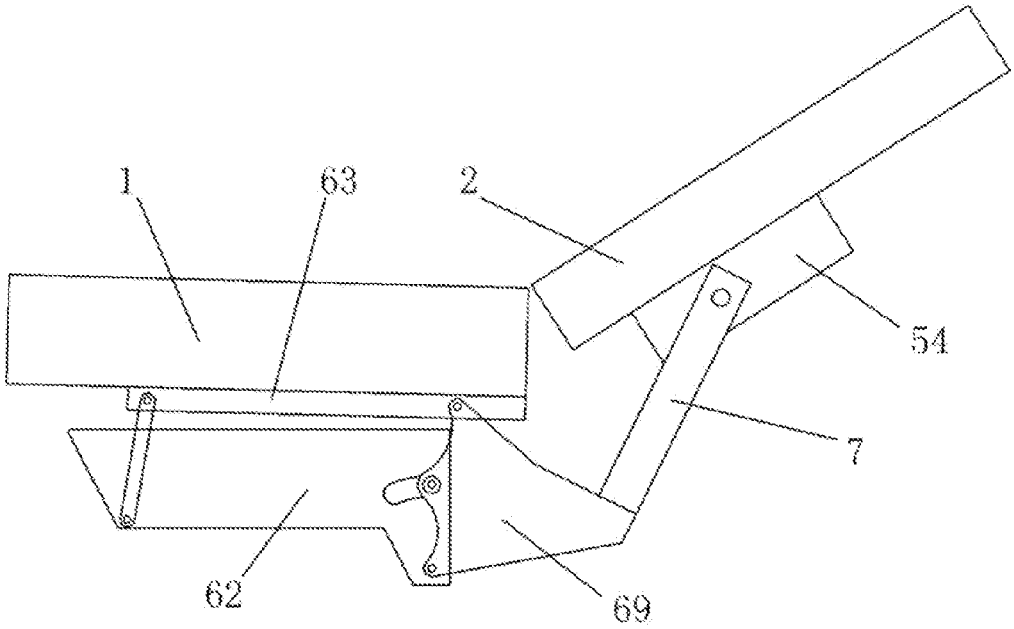
FIG. 8 is a structure diagram of a chair in accordance with embodiment 3 of the present invention (backrest is inclined).

A chair as shown in FIGS. 7 and 8, comprising a seat 1, a backrest 2, a chair base, a first connector descried in embodiment 1 and a second connector descried in embodiment 2, wherein both the base holder of the first connector and the base support 62 of the second connector are rigidly connected to the chair base; the seat 1 is rigidly connected to the seat support 63 of the second connector; the backrest 2 is rigidly connected to the back holder of the first connector; and the back support 69 of the second connector is pivotally connected to the rotation holder 54 of the first connector through a extension bar 7. Please refer to embodiment 1 for the structure of the first connector and refer to embodiment 2 for the structure of the second connector. The position mechanism and reposition mechanism are described in embodiment 2 and not repeated herein.

FIG. 7 shows the chair when the backrest 2 is in the original position. When a user tilts the backrest 2 backward, the backrest 2 rotates clockwise; the back support 69 of the second connector rotates downward; the seat support 63 actuates the seat 1 to move backward; and the rotation holder of the first connector actuates the backrest 2 to move downward through the second linkage bar, the third linkage bar, the first linkage bar and the back holder 52, as shown in FIG. 8.

Embodiment 4

Figure 9:
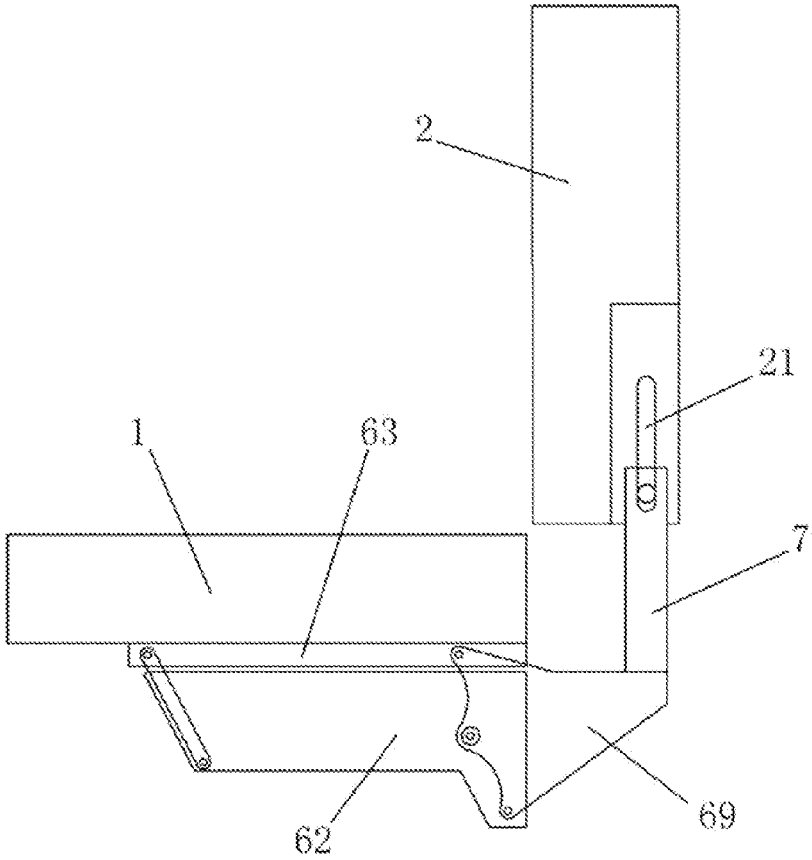
FIG. 9 is a structure diagram of a chair in accordance with embodiment 4 of the present invention (backrest is in original position).
Figure 10:
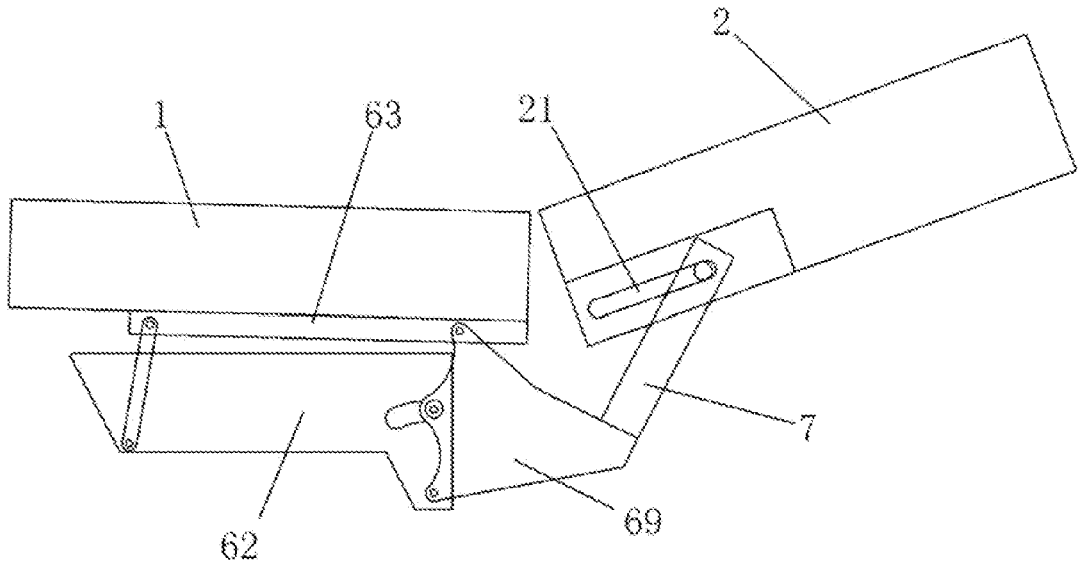
FIG. 10 is a structure diagram of a chair in accordance with embodiment 4 of the present invention (backrest is inclined).

A chair as shown in FIGS. 9 and 10, comprising a seat 1, a backrest 2, a chair base, a first connector descried in embodiment 1 and a second connector descried in embodiment 2, wherein both the base holder of the first connector and the base support 62 of the second connector are rigidly connected to the chair base; the seat 1 is rigidly connected to the seat support 63 of the second connector; the backrest 2 is rigidly connected to the back holder of the first connector; a extension bar 7 is provided on the back support 69 of the second connector; a guide sliding slot 21 is provided on the backrest 2; and a top end of the extension bar 7 is non-rigidly connected to the guide sliding slot 21 through a sliding wheel. Please refer to embodiment 1 for the structure of the first connector and refer to embodiment 2 for the structure of the second connector. The position mechanism and reposition mechanism are described in embodiment 2 and not repeated herein.

FIG. 9 shows the chair when the backrest 2 is in the original position. When a user tilts the backrest 2 backward, the backrest 2 rotates clockwise; the back support 69 of the second connector rotates downward; the seat support 63 actuates the seat 1 to move backward; and the rotation holder of the first connector actuates the backrest 2 to move downward through the second linkage bar, the third linkage bar, the first linkage bar and the back holder 52, as shown in FIG. 10.

What is claimed is:

1. A chair comprising:

a seat, a backrest and a chair base;

a first connector, which connects the backrest and the chair base together, the first connector comprises:

a base holder rigidly connected to the chair base, a back holder secured to the backrest, a rotation holder, a first linkage bar, a second linkage bar and a third linkage bar;

the rotation holder is pivotally connected to the base holder, the back holder is connected to the rotation holder through a linear sliding connection; one end of the first linkage bar is pivotally connected to the back holder, a second end of the first linkage bar is pivotally connected to one end of the third linkage bar, one end of the second linkage bar is pivotally connected to the rotation holder, a second end of the second linkage bar is pivotally connected to a middle point of the third linkage bar, a second end of the third linkage bar is pivotally connected to the base holder;

a reposition mechanism installed on the chair base for moving the backrest forward to return to its original position during backward inclination of the backrest; and a position mechanism installed on the chair base for positioning the backrest at a tilt angle.

2. The chair of claim 1, wherein a guide rail is provided on the rotation holder, a sliding block is provided on the guide rail; and the sliding block is rigidly connected to the back holder.

3. The chair of claim 1, wherein the seat is fixed on the chair base.

4. The chair of claim 1, wherein the seat and the chair base are connected through a second connector that comprises a base support fixed to the chair base, a back support fixed to the backrest and a seat support secured to the seat, the base support, back support, seat support and a connecting plate are pivotally connected to each other to compose a four-bar linkage.

5. The chair of claim 4, wherein the reposition mechanism includes an extension spring, one end of the extension spring is connected to the base support, a fixed lever is provided between a pivot point of the back support with the seat support and a pivot point of the back support and the base support, a second end of the extension spring is connected to the fixed lever, and the fixed lever penetrates the base support through a guide hole or a guide slot inside which the fixed lever is movable.

6. The chair of claim 5, wherein a rotatable tensioning bolt is provided inside the base support; the tensioning bolt is connected with an end of the extension spring by a screw connection; a rotatable adjusting lever is provided on the base support; and the adjusting lever is connected with the tensioning bolt by a transmission connection.

7. The chair of claim 4, wherein the position mechanism comprises a finger clamp being on a fixed lever, a clamp tooth provided at a front end of the finger clamp, and a plurality of clamp slots which are fit to the clamp tooth are provided on the base support.

8. The chair of claim 7, wherein a finger clamp control mechanism for restricting rotation of the finger clamp is provided on the base support or the back support.

9. The chair of claim 4, wherein the back support of the second connector is pivotally connected to the rotation holder of the first connector.

10. The chair of claim 4, wherein the back support of the second connector is non-rigidly connected to the backrest through a guide sliding slot and a sliding wheel.

* * * * *